US006689972B1

(12) United States Patent
Frolov et al.

(10) Patent No.: US 6,689,972 B1
(45) Date of Patent: Feb. 10, 2004

(54) HIGH SECURITY SWITCH

(75) Inventors: George Frolov, Farmington, CT (US); Victor Bogdanov, Manchester, CT (US); Alfred S. Levesque, Newington, CT (US)

(73) Assignee: Harrow Products, Inc., Woodcliff Lake, NJ (US)

( * ) Notice: Subject to any disclaimer, the term of this patent is extended or adjusted under 35 U.S.C. 154(b) by 114 days.

(21) Appl. No.: 09/945,973

(22) Filed: Sep. 4, 2001

(51) Int. Cl.[7] ..... H01H 27/06

(52) U.S. Cl. ..... 200/61.64; 200/61.7; 200/404; 335/207

(58) Field of Search ..... 200/61.64, 61.65, 200/61.67, 61.68, 61.69, 61.7, 61.73, 61.76, 61.78, 61.81, 404, 414; 335/205, 206, 207

(56) References Cited

U.S. PATENT DOCUMENTS 3,944,762 A * 3/1976 Coleman et al. ..... 200/44
4,012,731 A * 3/1977 Solomon ..... 340/274 R
4,292,629 A * 9/1981 Kerr et al. ..... 340/547
4,758,697 A * 7/1988 Jeuneu ..... 200/61.64
4,803,467 A * 2/1989 Peters ..... 340/542
4,845,471 A * 7/1989 Chu ..... 340/542
4,868,530 A * 9/1989 Ahs ..... 335/207
5,578,977 A * 11/1996 Jansseune ..... 335/207

* cited by examiner

*Primary Examiner*—Elvin Enad
*Assistant Examiner*—K. Lee
(74) *Attorney, Agent, or Firm*—Michael Best & Friedrich LLP

(57) ABSTRACT

A high security switch employs cooperative magnets which define the mode characteristics of the switch. The polarities and/or pole orientations between various magnets of the assembly are selected so that momentary or maintain switch positions can be obtained. The switch positions are activated by a key operated plug which causes rotation of an operator arm to a selected position.

16 Claims, 10 Drawing Sheets

HIGH SECURITY SWITCH

BACKGROUND OF THE INVENTION

This invention relates generally to switches which are activateable to control access to secured areas. More particularly, this invention relates to key operated switches employed in high security systems.

In devices to which the invention relates, a key operated switch is employed to open or close an electrical switch which sends a signal to a security system. The signal may, for example, allow limited access, prevent access or, depending on additional factors, provide selective access to a secured area. The signal may be high or low and accordingly may be termed a "momentary" transmittal or may have a duration for an extended period of time which may be termed a "maintain" mode. For some related switch devices, there may be multiple switch settings at various angular positions of the key upon rotation. In highly sophisticated security systems capable of a wide variety of security functions, numerous switches may be employed. Each of the switches may require a specific configuration for a given function, location or signal component of the integrated security system.

SUMMARY OF THE INVENTION

Briefly stated, the invention in a preferred form is a high security switch which incorporates an efficient system for implementing a momentary and/or maintain switch modes. The high security switch comprises a cam operator which is mounted in fixed rotatable relationship with a plug of a lock cylinder. A pendulum-like arm is pivotably mounted relative to a base for the lock cylinder. A magnet is carried by the arm. A second magnet is mounted in a fixed relationship with respect to the base and alignable with the first magnet upon pivotable movement of the arm to define a first mode, i.e., momentary or maintain mode, which is defined by the relative polarities of the opposed magnets. In the maintain mode, the arm is pivotably maintained in a given angular position under the magnetic attraction of the magnets. In the momentary mode, the magnets repel and the arm pivotably moves from a position wherein the first and second magnets align. The switch may employ magnets to provide a momentary and maintain mode at spaced angular positions upon selective directional rotation of the key. In one embodiment, a pair of electrical switches, each having two states, is mounted to a panel. The arm carries a pin which engages one or the other of the electrical switches to close the switch contacts.

In accordance with the invention, a method is also provided for setting the operate characteristics of a multi-positional switch wherein switch positions are defined by a pair of opposing poles of magnets. The method may also comprise providing an extractor having a magnetic field strength which is greater than that of the magnets, magnetically bonding the extractor to the magnet, removing the bonded magnet from the switch assembly and inserting a magnet having a selective polarity orientation into the assembly. The method step may essentially comprise merely reversing the orientation of the magnet.

An object of the invention is to provide a new and improved switch for a high security system.

Another object of the invention is to provide a new and improved high security switch having an efficient and reliable operation.

A further object of the invention is to provide a new and improved high security switch that does not require a mechanical spring return mechanism or a mechanical spring for indexing at a given switch position.

A yet further object of the invention is to provide a new and improved high security switch which may be custom configured in the field for a wide range of signal functions in a highly efficient and reliable installation process.

Other objects and advantages of the invention will become apparent from the specification and the drawings.

DETAILED DESCRIPTION OF THE PREFERRED EMBODIMENTS

Figure 1:
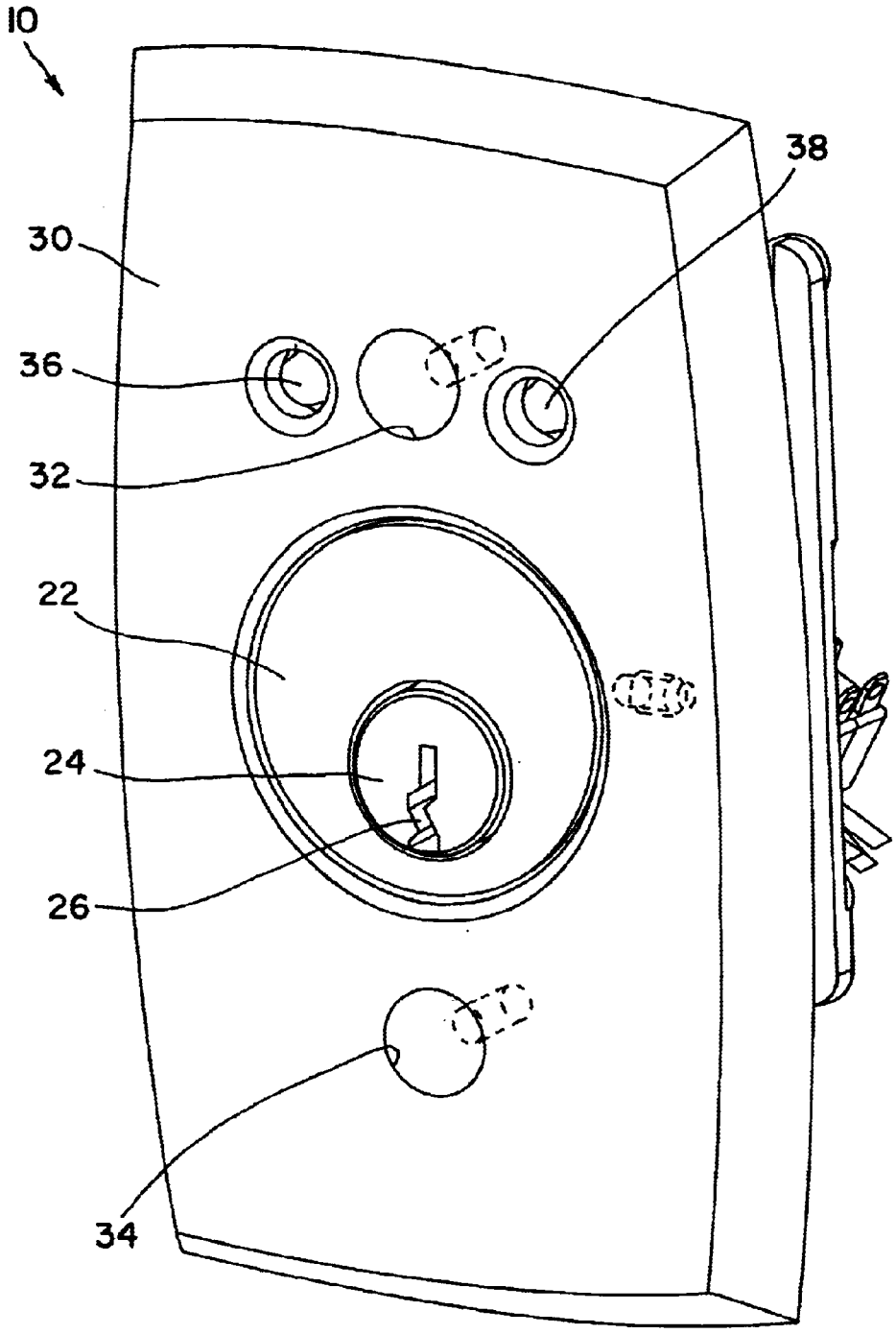
FIG. 1 is a frontal perspective view of a high security switch in accordance with the present invention.

With reference to the drawings, wherein like numerals represent like parts throughout the several figures, a high security switch in accordance with the present invention is generally designated by the numeral 10. The high security switch 10 is preferably employed in conjunction with a high security system for controlling access to a secured area. The high security switch 10 is typically mounted to a wall (not illustrated) and activated by means of a key (not illustrated) for transmitting an electrical signal to the system. Several such switches are typically employed in a given security system. The high security switch 10 is a secure multi-positionable switch that may assume a number of possible switch configurations and may be readily configured and/or reconfigured in the field as required for a given function.

A support frame 20 which is preferably a unitary construction provides the principal support and assembly base for the switch. The frame has a central cavity 21 that receives a lock cylinder 22. The lock cylinder includes a rotatable plug 24. The cylinder 22 may be a conventional high security mechanical lock cylinder, which includes pin tumbler stacks (not illustrated). The plug 24 has a keyway 26 which receives a key (not illustrated). A proper key defines a parting line between the pins and allows the plug to rotate to various angular positions. In accordance with one aspect of the present invention, the lock cylinder and the switch operator do not require a conventional spring return and/or index mechanism for returning the key plug and/or maintaining the plug in any given angular position.

The high security switch 10 includes a faceplate 30 which provides a front cover and surrounds the front face of the lock cylinder. A pair of openings 32 and 34 receive fasteners (not illustrated) for securing the faceplate to the wall, doorframe or other structures (none illustrated). The faceplate is also configured to accommodate LED's 36 and 38 which may be activated to visually indicate the status and/or other operational characteristics of the switch.

Figure 4:
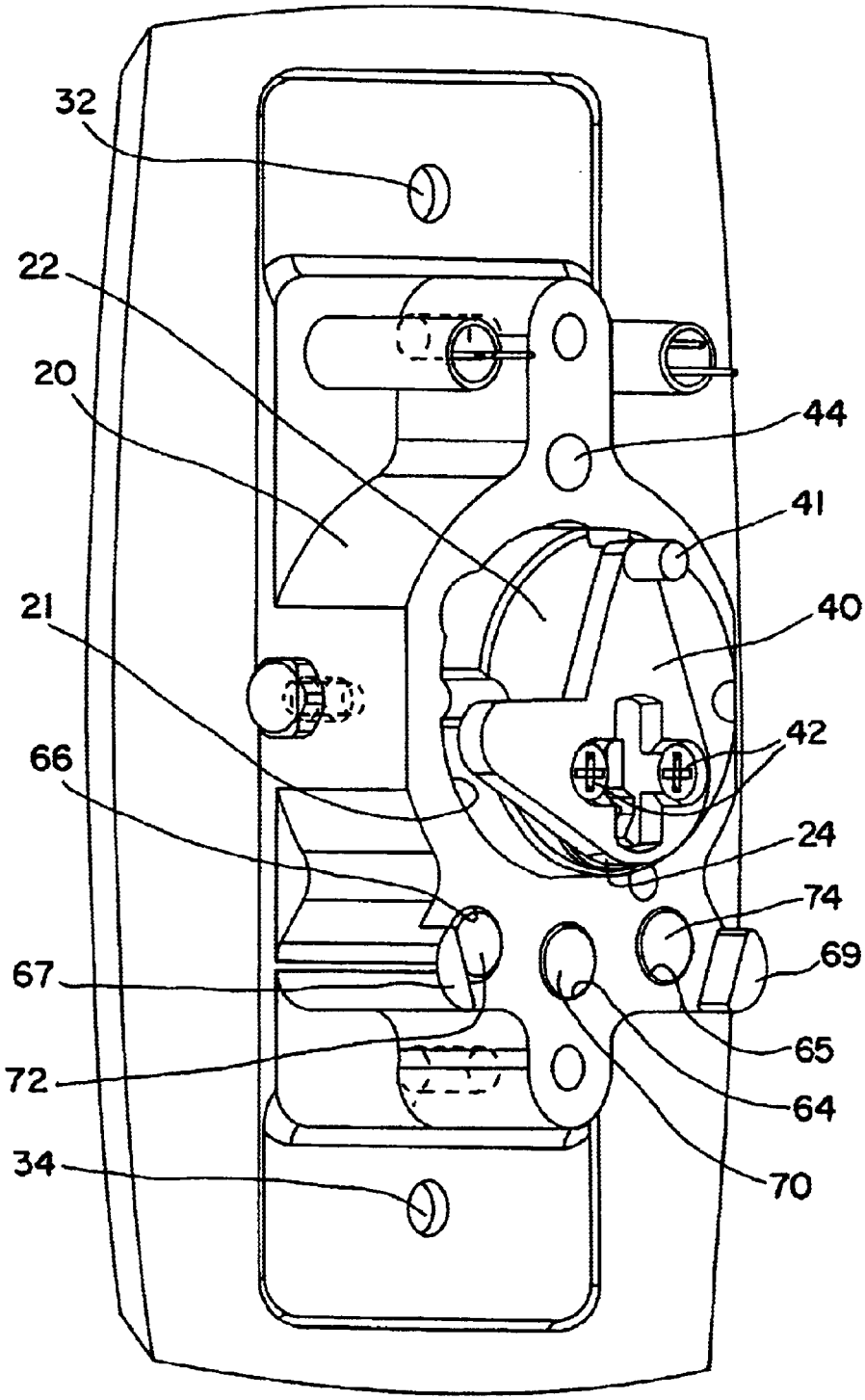
FIG. 4 is a rear perspective view of the high security switch of FIG. 1 with an operator sub assembly, the switch module portion and the rear cover being removed to show additional detail.
Figure 5:
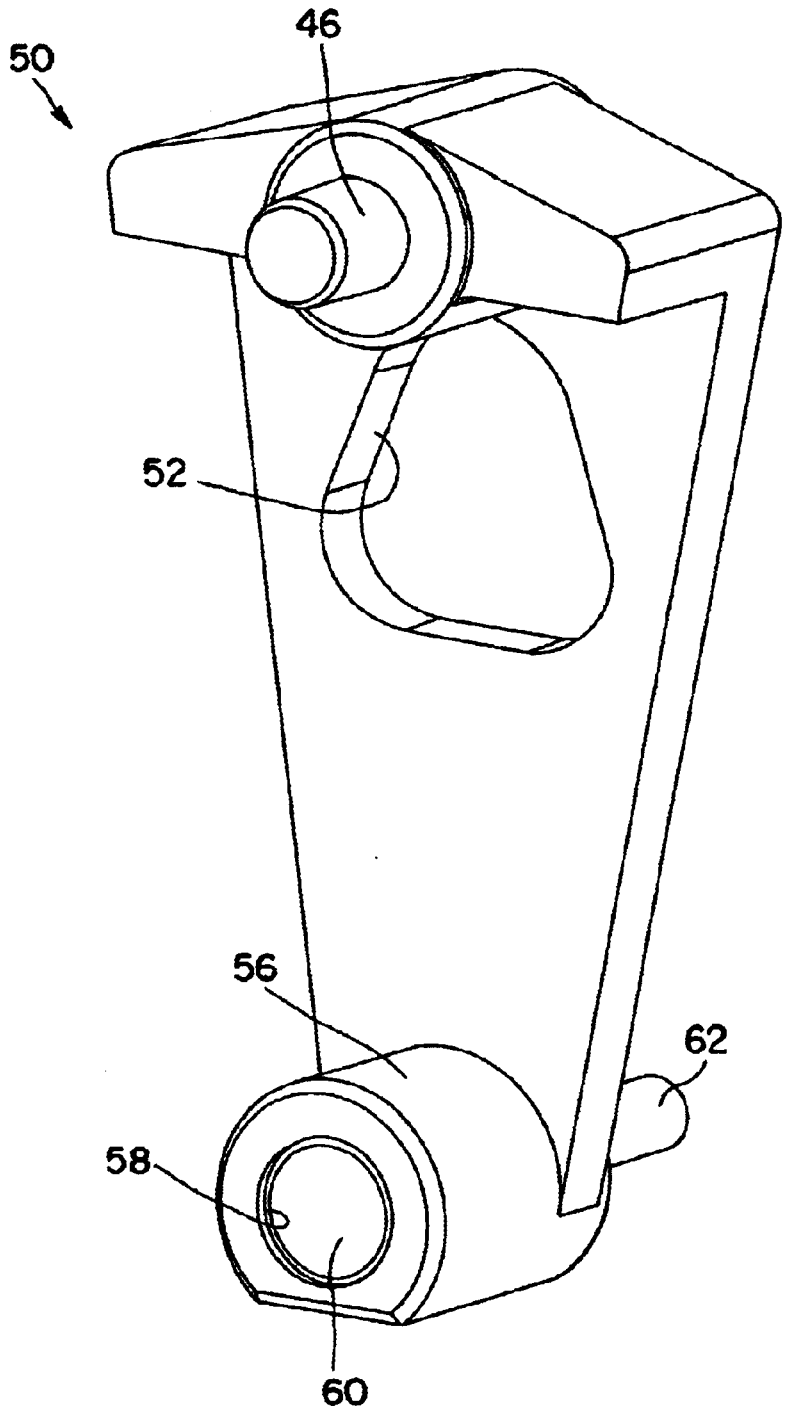
FIG. 5 is a frontal perspective view of an operator arm of the high security switch assembly of FIG. 1.

With reference to FIG. 4, a cam operator 40 is mounted at the rear of the plug 22 or an extension of the plug and secured by fasteners 42 so that it is disposed in rotatably fixed relationship with the plug. The operator has a rearwardly projecting pin 41. The support frame 20 includes a bore 44 which receives a projecting shaft 46 of a pendulum-like operator arm 50 (best illustrated in FIG. 5). The operator arm 50 is mounted for pivotal rotation about the shaft 46. In one embodiment, the operator arm has an opening, the sides of which form shoulders that function as a cam surface 52. The cam surface 52 is engageable by pin 41 of the cam operator 40 for pivoting the operator arm 50 to perform the switch functions upon rotation of the plug 24.

The lower end of the operator arm 50 includes a cylindrical boss 56 which extends forwardly and forms an opening 58 for receiving a cylindrical or disk-like magnet 60. At the opposite location of the operator arm is a rearward projecting pin or finger 62.

With reference to FIG. 4, the frame 20 also includes cylindrical bores 64, 65 and 66 which are positioned along an arcuate path alignable with the arcuate path of the magnet 60 as the arm 50 pivots. Cylindrical or disk-like magnets 70, 72 and 74 are respectively inserted into the bores. The magnets 70, 72 and 74 have opposite magnetic polaries at the opposite ends thereof and preferably are similar or identical to magnet 60. A pair of integral stops 67 and 69 of the frame 20 project rearward to limit the pivot angle of the operator arm 50.

Figure 2:
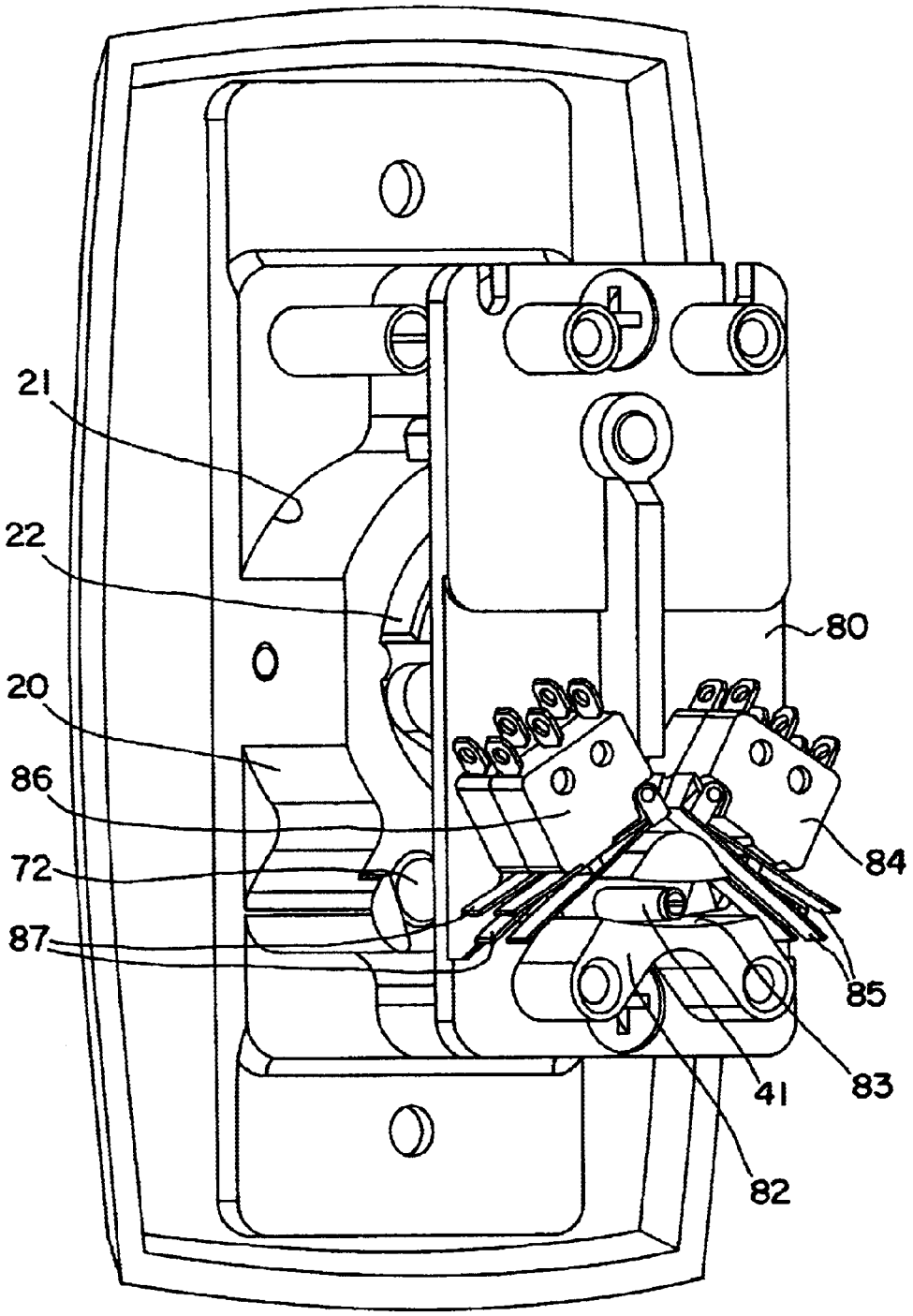
FIG. 2 is a rear perspective view of the high security switch of FIG. 1 with a rear cover being removed to show additional detail.
Figure 3:
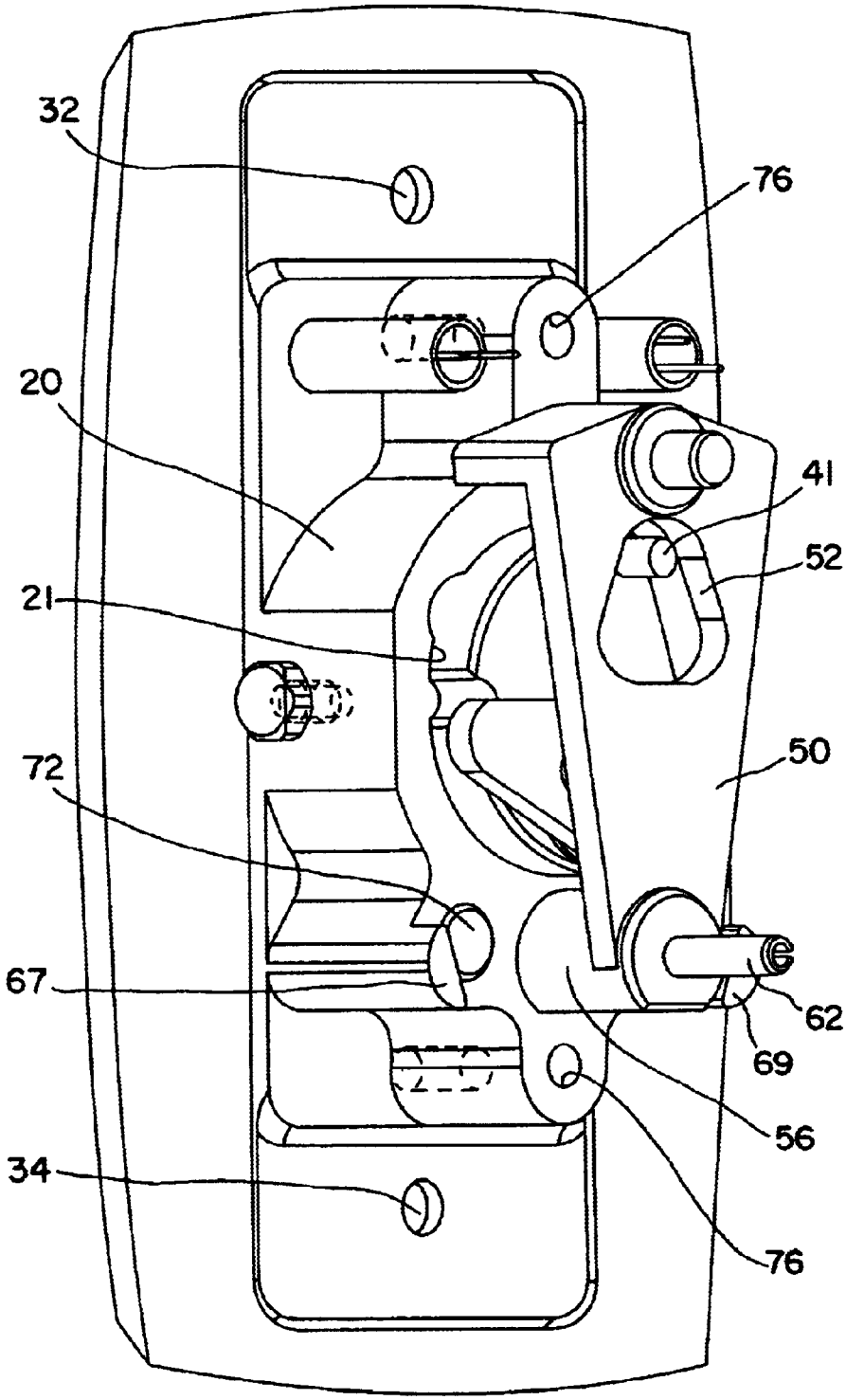
FIG. 3 is a rear perspective view of the high security switch of FIG. 1 with a switch module portion and the rear cover being removed to show additional detail.

With reference to FIG. 2, a switch panel 80 is mounted at the rear behind the operator arm 50. The switch panel 80 integrally mounts an inverted V-shaped boss 82 which defines a cross slot 83 that also extends through the panel 80. A pair of switches 84 and 86 are mounted above each side of the boss 82. The switches 84 and 86 include respective actuators or electrical contacts 85 and 87, which upon engagement from the underside by the operator arm pin or finger 62, activate the switch by engaging the contacts 85 and 87 and provide for the transmission of an electrical signal. It will thus be seen that upon rotation of the key, the cam operator 40 pivots the operator arm 50 which carries the pin 62 to engage and close the electrical contacts of switch 84 or 86 depending upon the direction of rotation of the key plug.

Figure 6:
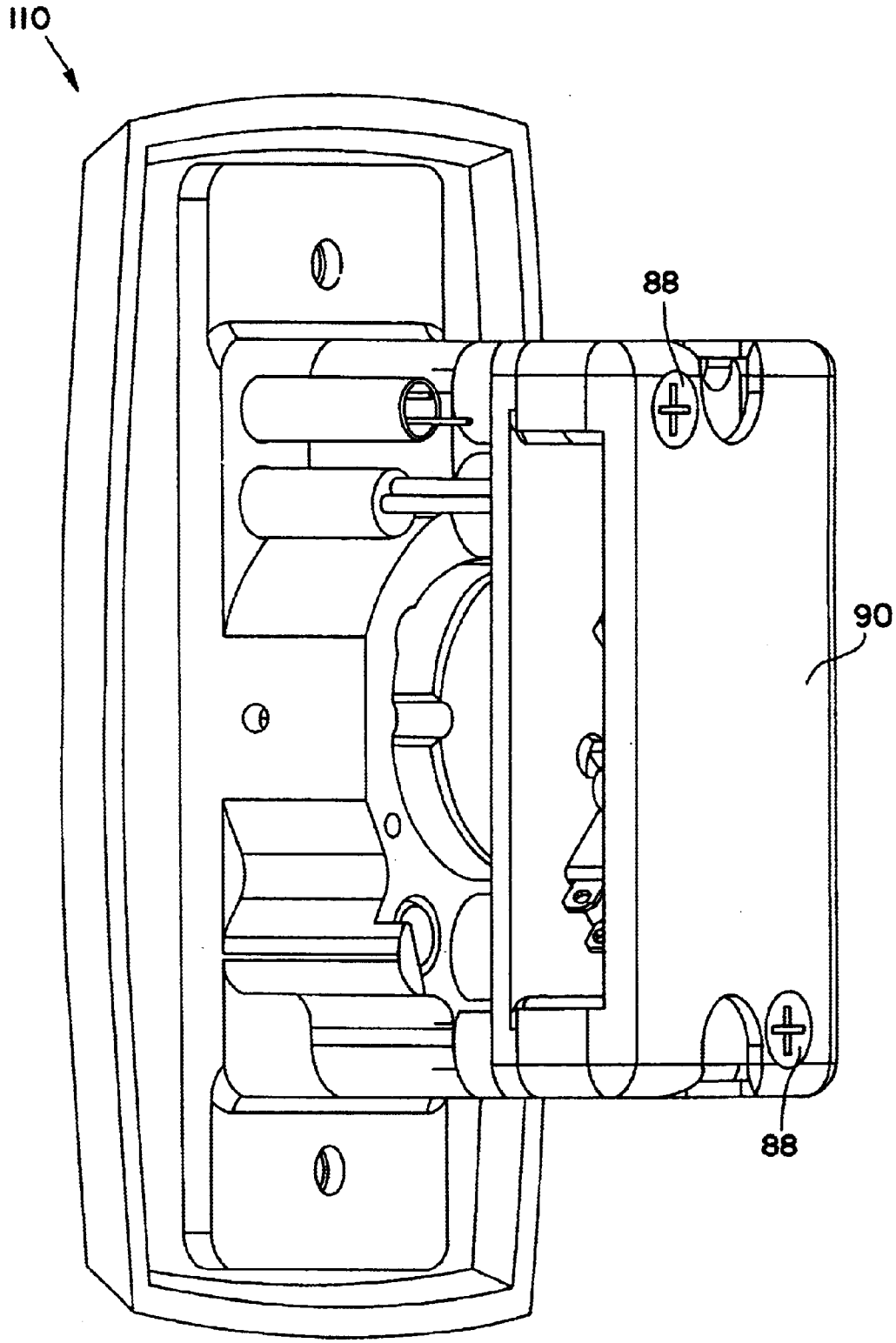
FIG. 6 is a rear perspective view of a second embodiment of a high security switch in accordance with the present invention.

With reference to FIG. 6, fasteners 88 extend through the back cover plate 90 which thread through spaced threaded bores 76 of the frame to secure the various components in the proper position.

The position of the operator arm 50 and the resultant signal mode of the switches 84 and 86 is determined by the magnet 60 and the interaction with magnets 70, 72 and 74. Each of the magnets functions as a bar magnet with opposite magnetic poles at opposite ends. Orientation of the magnetic poles determines the specific signal configuration for the switch. In one embodiment of the invention, magnet 60 has a North Pole adjacent the path of the operator arm 50. Magnet 70 has a South Pole adjacent the interface with the operator arm. Accordingly, magnet 72 has a North Pole and magnet 74 has a South Pole adjacent the path of the operator arm. It should be appreciated that the foregoing magnet relationships provide a switch wherein in the stable non-activated key mode neither switch 84 or 86 is activated. In the key cylinder position without insertion of the key or rotation of the key, the operator arm has the essentially null position illustrated in the drawings, and magnet 60 and magnet 70 attract each other to define a stable null position.

When the key plug and the operator arm are rotated so that magnets 60 and 72 essentially align, because of the different adjacent polarities, the magnets essentially function to attract each other so that the switch 84 is only momentarily tripped and a "momentary" signal is transmitted. The repelling force of the magnets urges the operator arm and the switch to return to the stable null position. When the operator arm is pivoted in the opposite direction because the poles are configured with opposite adjacent polarities between magnet 62 and magnet 74, there is an attraction between the operator arm at that position and the closed position of the switch is "maintained" until the switch is physically returned by rotation of the key to the null position. Accordingly, it should be appreciated that a "momentary" or "maintain" switch configuration can relatively easily be implemented by the custom pole configuration of the various magnets.

Figure 7:
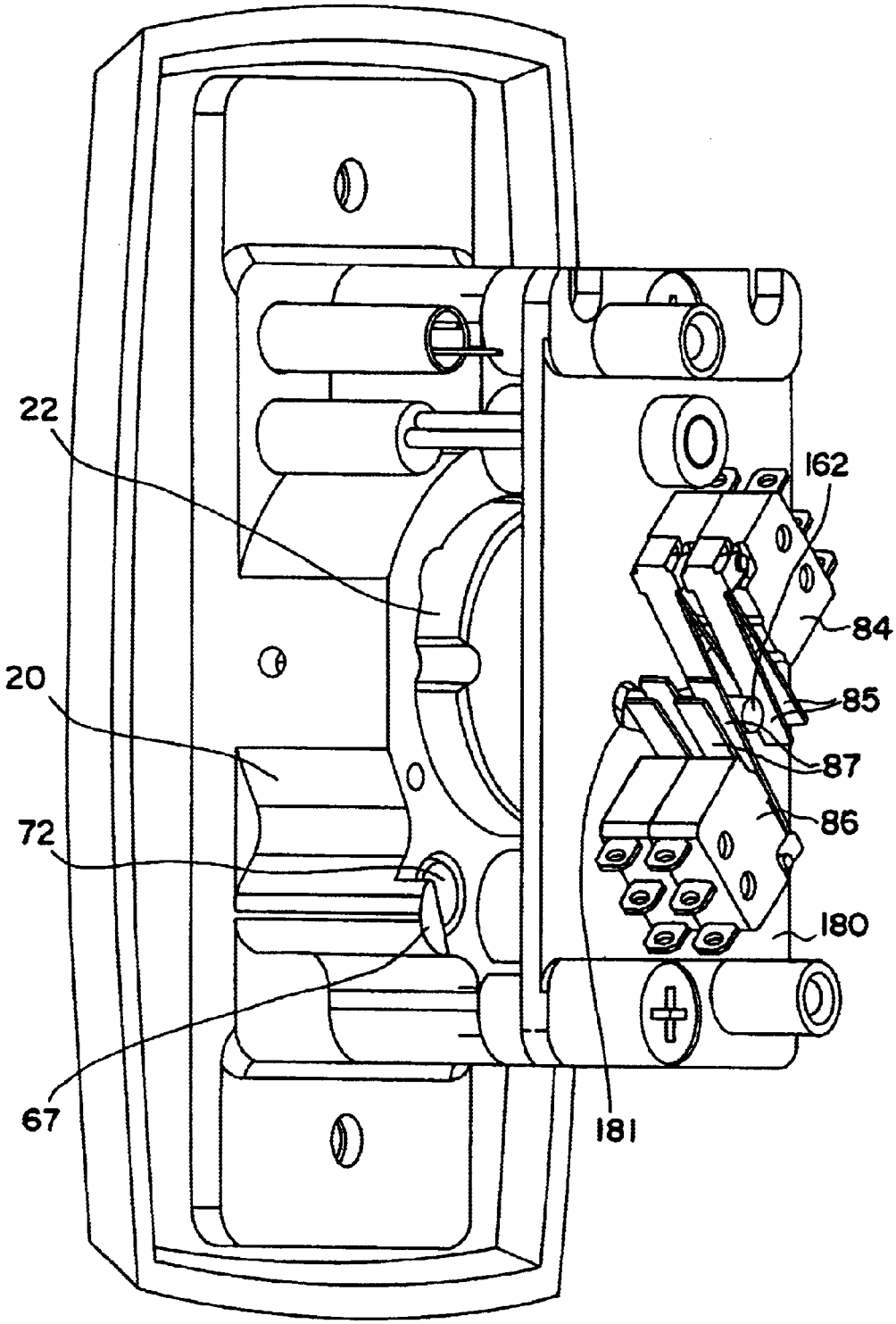
FIG. 7 is a rear perspective view of the high security switch of FIG. 6 with a rear cover being removed to show additional detail.
Figure 8:
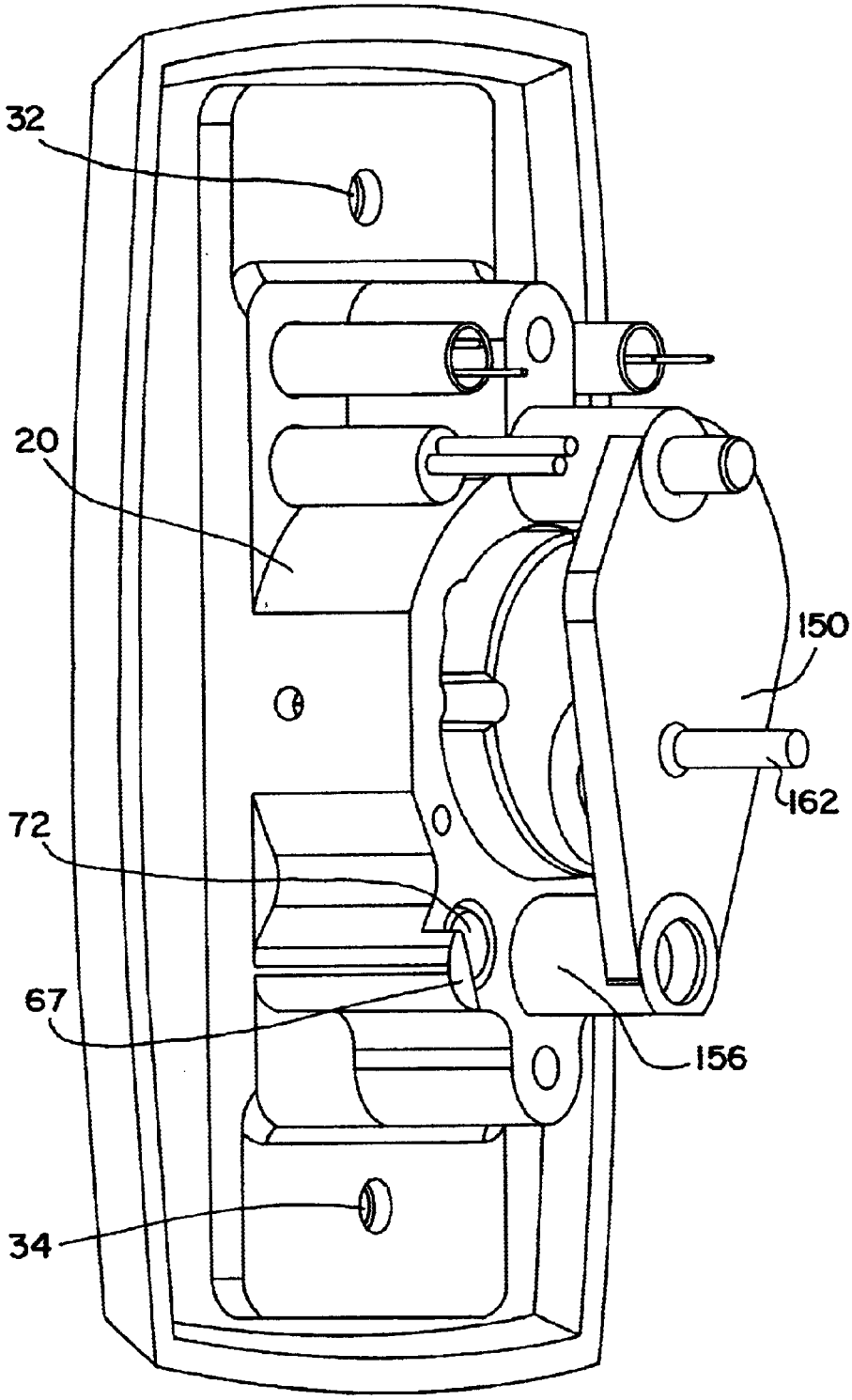
FIG. 8 is a rear perspective view of the high security switch of Figure 6 with the switch module portion and the rear cover being removed to show additional detail.
Figure 9:
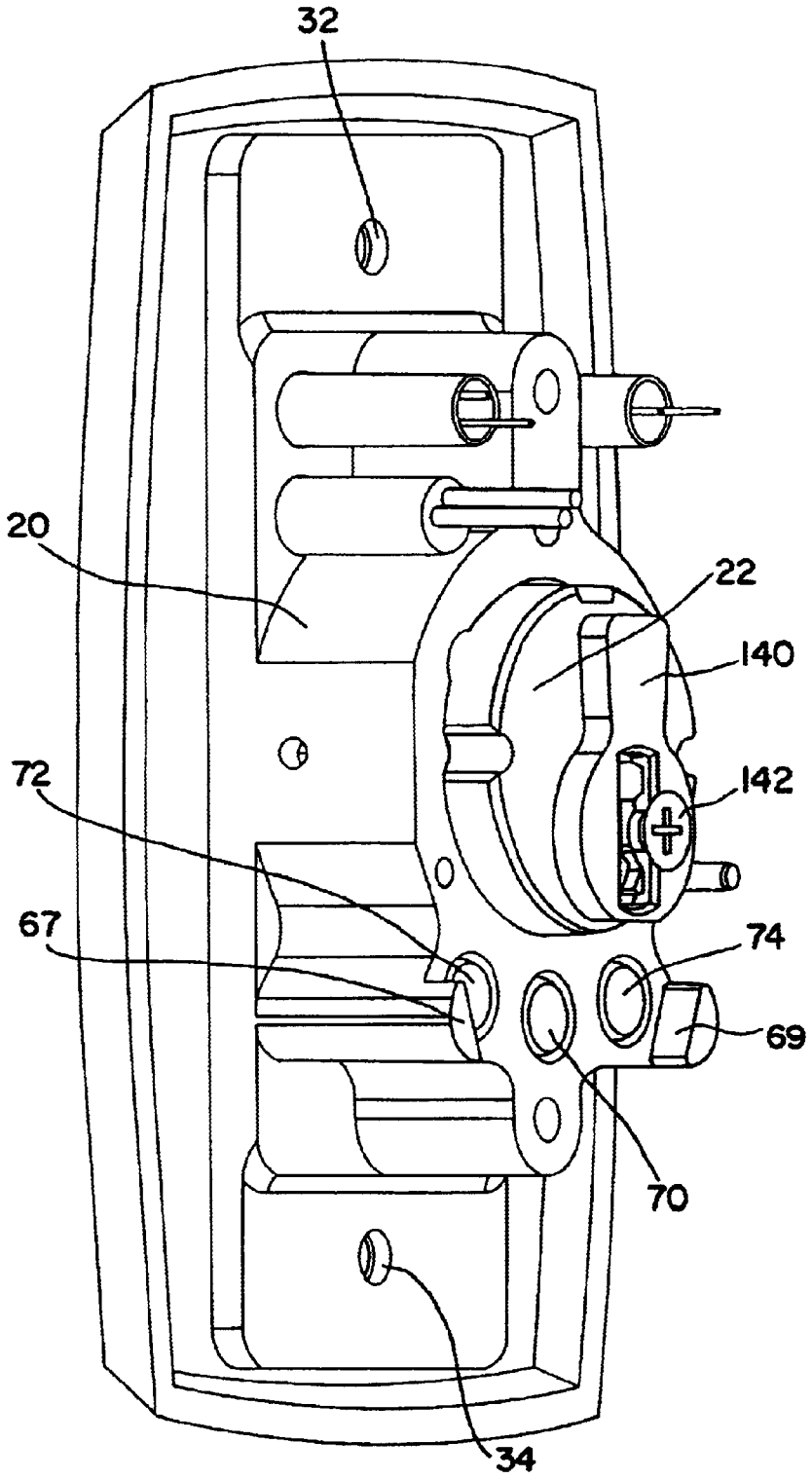
FIG. 9 is a rear perspective view of the high security switch of FIG. 6 with an operator sub assembly, the switch module portion and the rear cover being removed to show additional detail.
Figure 10:
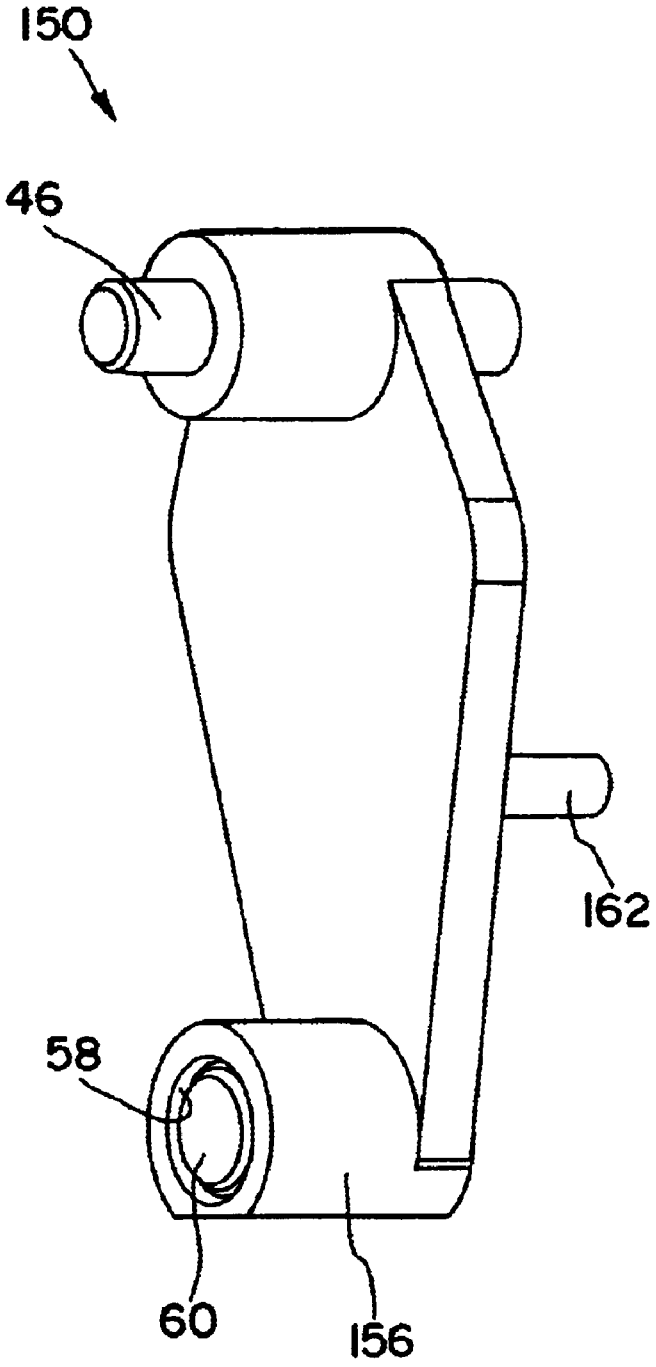
FIG. 10 is a frontal perspective view of a second embodiment of an operator arm which is employed in the high security switch assembly of FIG. 6.

With reference to FIGS. 6 through 10, a second embodiment of a key switch is generally designated by the numeral 110. As best illustrated in FIG. 7, the switches 84 and 86 are mounted to a switch panel 180 so that they are configured in an opposing oblique configuration. A switch pin 162 extends transversely through an arcuate slot 181 (partially illustrated) of the switch panel 180 and is engageable upon angular movement through the slot against contacts 85 or 87 switches 84 or 86 to open or close the switches. Operator arm 150 (FIGS. 8 and 10) has a slightly different configuration than operator arm 50. The switch pin 162 is fixedly mounted to extend transversely from the rear side of the operator arm. The cam operator 140, which may be conventional, is rotatably fixed to the plug 24 or an extension of a plug. In this embodiment, the cam operator 140 engages the cylindrical boss 156 of the operator arm to pivot the operator arm 150 and thereby selectively move the switch pin 162. Otherwise, the operator arm 150 and high security switch 110 function in substantially the same manner previously described for the operation of operator arm 50 and high security switch 10.

The switch modes can be selectively determined by the proper setting and/or orientation of the poles of the magnets. The magnets can be removed by means of a strong magnet. For instance, if it is desired to change the polarity of magnet 72, a strong magnet is placed so that its opposite pole is adjacent to the end of the magnet. The strong magnet functions as an extractor and is pulled to remove the magnet from the bore. A new magnet having an opposite end polarity can be inserted into the bore. For example, the switch position can be changed from a "momentary" to a "maintain" switch position. Alternatively, the magnet may be reversed from end-to-end and reinserted thereby reversing the signal mode. It should be appreciated that each of the magnets may be accordingly custom selected according to a given required signal mode configuration for a given application. Of course, it will likewise be appreciated that the switches 84 or 86 may be oppositely configured so that activation of the electrical switch can transform to on (high) or off (low) as desired.

While preferred embodiments of the foregoing invention have been set for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A high security switch comprising:

a base;

a lock cylinder comprising a plug defining a keyway rotatable relative to said cylinder upon insertion of a proper key and rotation thereof, said lock cylinder mounted to said base;

a cam operator mounted in fixed rotatable relationship with said plug and pivotable therewith upon rotation of said plug;

an arm pivotally mounted-relative to said base and engageable by said operator for pivotal movement in response to rotation of said plug to define a switch state;

a first magnet carried by said arm; and a second magnet mounted in fixed relationship relative to said base and alignable with said first magnet upon pivotal movement of said arm to define a first mode defined by the relative opposed polarities of said first and second magnets.

2. The high security switch of claim 1 wherein said first mode is a maintain mode wherein said first and second magnets attract and said arm is pivotally maintained in a given angular position.

3. The high security switch of claim 1 wherein said first mode is a momentary mode wherein said first and second magnets repel and said arm pivotally moves away from a position wherein said first magnet and second magnets align.

4. The high security switch of claim 1 further comprising an electrical switch and said arm carries a pin which engages said electrical switch upon movement of said arm to the first mode.

5. The high security switch of claim 1 further comprising a third magnet mounted in fixed relationship to said base and alignable with said first magnet upon pivotal movement of said arm to define a second mode defined by the relative polarities of said first and third magnets.

6. The high security switch of claim 5 wherein said first mode is a momentary mode and said second mode is a maintain mode.

7. The high security switch of claim 1 further comprising a third magnet and a fourth magnet, each mountable to said base and alignable with said first magnet upon pivotal movement of said arm to define second and third modes defined by the relative polarities of said first and third magnets and said first and fourth magnets.

8. The high security switch of claim 7 and further comprising two electrical switches each having two states and wherein said arm carries a transversely projecting structure which at spaced angular positions engages an electrical switch to change a state.

9. A high security switch comprising:

a base;

a lock cylinder comprising a plug defining a keyway rotatable relative to said cylinder upon insertion of a proper key and rotation thereof, said lock cylinder mounted to said base;

an arm pivotally mounted relative to said base and pivotally moveable in response to rotation of said plug from a first position to a second position;

a first magnet carried by said arm; and a second magnet mounted in fixed relationship relative to said base and alignable with said first magnet upon pivotal movement of said arm to said second position to define a first mode defined by the relative opposed polarities of said first and second magnets;

an electrical switch mounted in fixed relationship to said base and having a displaceable actuator for defining a first state and a second state, wherein said switch changes from the first state to the second state when said plug is rotated from said first position to said second position.

10. The high security switch of claim 9 wherein said first mode is a maintain mode wherein said first and second magnets attract and said arm is pivotally maintained in said second position.

11. The high security switch of claim 9 wherein said first mode is a momentary mode wherein said first and second magnets repel and said switch member pivotally moves away from said second position when said first magnet and second magnets align.

12. The high security switch of claim 9 further comprising a third magnet mounted in fixed relationship to said base and alignable with said first magnet upon pivotal movement of said arm to define a second mode defined by the relative polarities of said first and third magnets.

13. The high security switch of claim 12 wherein said first mode is a momentary mode and said second mode is a maintain mode.

14. The high security switch of claim 9 wherein said arm further carries a transversely projecting structure which engages the actuator.

15. The high security switch of claim 9 further comprising a third magnet and a fourth magnet mountable to said base at a third position and alignable with said first magnet upon pivotal movement of said arm to define second and third modes defined by the relative polarities of said first and third magnets and said first and fourth magnets.

16. The high security switch of claim 15 wherein said second, third and fourth magnets are arranged along an arcuate path.

* * * * *